United States Patent [19]

Groom

[11] Patent Number: 4,570,796

[45] Date of Patent: Feb. 18, 1986

[54] PACKAGE FOR FLOPPY DISK ENVELOPES

[75] Inventor: James S. Groom, Wales, Mass.

[73] Assignee: Westvaco Corporation, New York, N.Y.

[21] Appl. No.: 648,057

[22] Filed: Sep. 7, 1984

[51] Int. Cl.[4] ..... B65D 83/00; B65D 65/28; B65D 65/32; B65D 85/62

[52] U.S. Cl. ..... 206/449; 206/434; 206/445; 206/499; 229/40; 206/628

[58] Field of Search ..... 206/449, 628, 499, 434, 206/526, 554, 445, 45.31, 444; 229/40

[56] References Cited

U.S. PATENT DOCUMENTS

| | | | |
|---|---|---|---|
| 2,342,565 | 2/1944 | Weeks | 206/499 |
| 2,364,916 | 12/1944 | Rasmussen | 206/445 |
| 2,395,558 | 2/1946 | Lighter | 206/45.31 |
| 3,111,223 | 11/1963 | Jacobi | 206/434 |
| 3,263,957 | 11/1944 | Goff | 206/628 |
| 3,313,404 | 4/1967 | Hekman | 206/526 |
| 4,484,681 | 11/1984 | Consigilo | 206/499 |

*Primary Examiner*—William T. Dixson, Jr.

[57] ABSTRACT

A wrapper or sleeve-type package is disclosed for packaging, shipping and dispensing flat stacked articles in bulk such as envelopes. The package comprises an elongated construction having the same shape in cross section as the packaged articles, with foldably connected top, bottom and end panels and open side walls. The articles are retained in the package by short flap extensions which are foldably connected to the sides of the top, bottom and end panels. The end of these short flap extensions are adhered together to complete the package. Meanwhile, the package further includes a novel opening means incorporated into the top panel for dispensing the articles into an automatic inserting machine or the like.

5 Claims, 12 Drawing Figures

PACKAGE FOR FLOPPY DISK ENVELOPES

BACKGROUND OF INVENTION

The present invention relates to the packaging and dispensing of flat, stacked articles. More particularly, the present invention relates to the packaging of articles such as envelopes or the like.

Such products must be packaged so that they may be readily loaded into automatic machinery for filling and sealing. Generally such products are collected in stacked bundles and specified counts of the products are packaged in conventional cartons either automatically or by hand. Upon being shipped to the user, the products must then be removed from their cartons and loaded into the feeding bins of the automatic filling and sealing apparatus. The conventional cartons used for this purpose in the past have been of the six-sided type with enclosed sides and ends. However such cartons suffer from several drawbacks. First, because the cartons completely enclose the packaged products, it is difficult to determine the identity or orientation of the packaged products before the carton is opened. Secondly, after opening the carton, it is difficult to transfer the stacked articles from the carton into the feeding bins of the automatic machinery. To offset these problems, the package of the present invention is designed to provide the user with a convenient package having easy identification of the packaged products and ease of loading into automatic equipment.

SUMMARY OF THE INVENTION

The present invention relates to the packaging and dispensing of flat stacked articles for use in automatic inserting apparatus. In particular, the present invention is directed to a package for envelopes or the like and would be especially useful to large volume users of bulk packed envelopes having automatic inserting equipment.

The package is constructed in the form of a wrapper or sleeve with open sides which provides easy identification of the packaged articles while keeping the articles covered until use. The open sided package also facilitates loading of the packaged articles into automatic inserting equipment. For the latter purpose, the wrapper includes a novel opening scheme for removing the wrapper from the stacked articles when it is desired to load the articles into the feeding bins of the automatic inserting equipment.

The package as disclosed herein is formed from a one piece blank of foldable paperboard or the like which is cut and scored to provide an elongated bottom panel located at one end of the blank, a rear end panel foldably connected to one end of the bottom panel, an elongated top panel foldably connected to the end of the rear panel opposite the top panel, a front end panel foldably connected to the other end of the top panel and a glue flap foldably attached to the end of the front end panel opposite the top panel. The bottom, top and end panels each include narrow flap extensions foldably attached to the side edges thereof which are folded inward along the sides of the package when it is formed to partially enclose the sides. The ends of these narrow flap extensions are secured to one another to hold the package together when it is formed, and the top wall and the narrow flap extensions foldable attached thereto each include connected, perforated lines which enable the top wall to be folded back for opening the package.

It is therefore an object of the present invention to provide a package for stacked articles which allows ready identification of the articles and their orientation without opening the package.

It is another object of the present invention to provide a novel opening means for such a package which enables the user to remove the wrapper from the stacked articles and load them in the feeding bins of automatic inserting equipment.

These and other objects, features and advantages of the present invention will become more obvious from the following detailed description taken in connection with the accompanying drawing.

DETAILED DESCRIPTION

Figure 1:
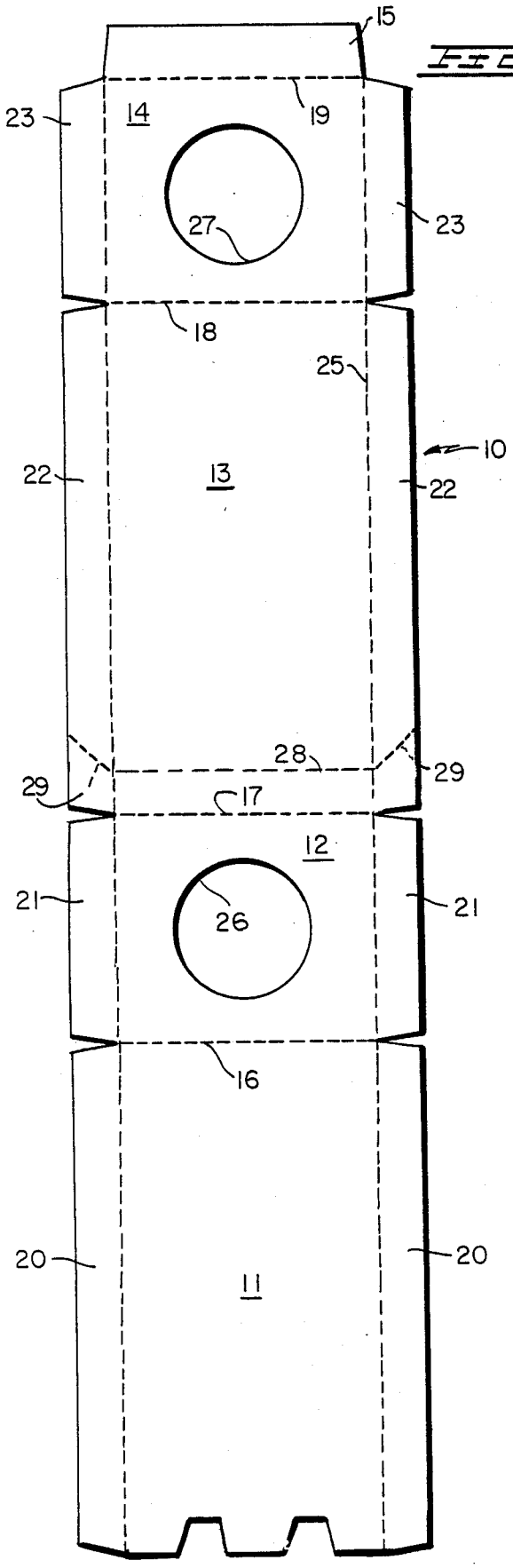
FIG. 1 is a plan view of the preferred blank for use in making the package of the present invention.

Referring more particularly to the drawings, the paperboard blank 10 illustrated in FIG. 1 represents a preferred construction of the blank for the present invention. It is of generally rectangular configuration and includes a plurality of primary panels including an elongated bottom panel 11, rear end panel 12, elongated top panel 13, front end panel 14 and a glue flap 15. These panels are connected to one another along fold lines 16, 17, 18 and 19. Meanwhile each of the primary panels 11, 12, 13 and 14 also include flap extensions 20, 21, 22 and 23 respectively, foldably attached at each side edge thereof along score lines 24, 25. The blank is further cut and scored to include viewing ports 26, 27 in end panels 12 and 14 respectively, and an easy opening means is applied to top panel 13 and its adjacent flap extensions 22, 22. The easy opening means comprises a scored fold line at one end of top panel 13 arranged parallel to score line 17 and located near the rear end panel 12, and a pair of perforated lines 29, 29 in flap extensions 22, 22. In the illustrated embodiment, the perforated lines 29, 29 are arranged to extend from the ends of score line 28 preferably in diagonally oriented diverging directions toward the other end of top panel 13, terminating at the outer edges of flap extensions 22, 22. These panels and flaps constitute the main panels of a wrapper or sleeve type structure as shown in FIG. 2.

Figure 2:
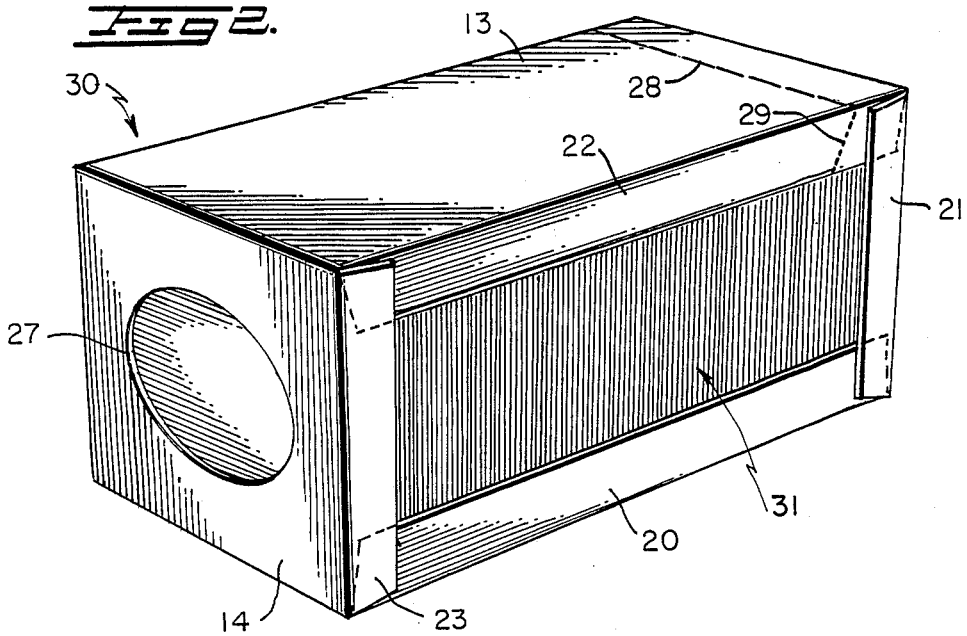
FIG. 2 is a perspective view of the package formed from the blank of FIG. 1.

FIG. 2 shows a perspective view of the wrapper or sleeve 30 formed from the blank 10 of FIG. 1. The wrapper or sleeve 30 is illustrated as being filled with a stack of envelopes 31 for use in an automatic inserting apparatus. The bottom or the end of the wrapper 30 is formed initially by gluing the corners of flap extensions 21, 21 attached to rear end panel 12 to the adjacent corners of the flap extensions 20, 20 and 22, 22 attached to the bottom and top panels 11 and 13. The stacked envelopes 31 are placed in the wrapper 30 and the top is closed by gluing the corners of flap extensions 23, 23 attached to front end panel 14 to the adjacent corners of the flap extensions 20, 20 and 22, 22, while the glue flap 15 attached to front end panel 14 is adhered to the bottom panel 11. These steps produce a package of stacked envelopes 31 as shown in FIG. 3.

Figure 3:
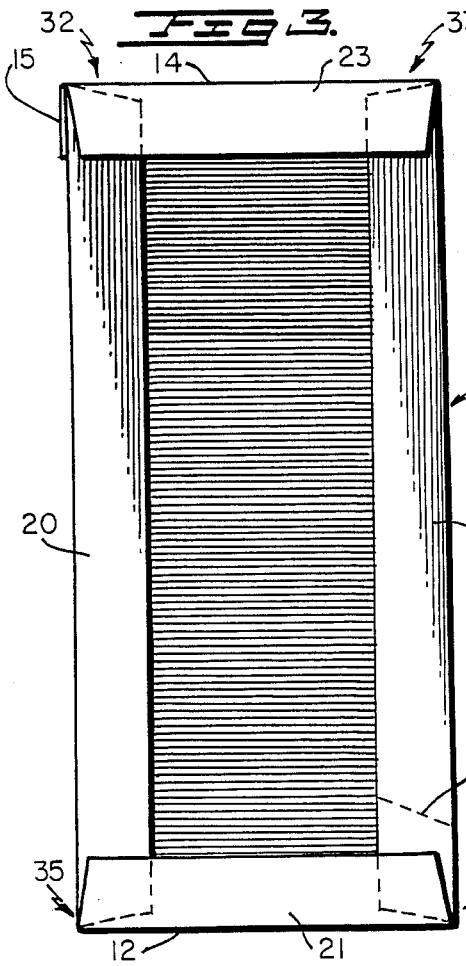
FIG. 3 is a side view of the package arranged on one end.
Figure 3:
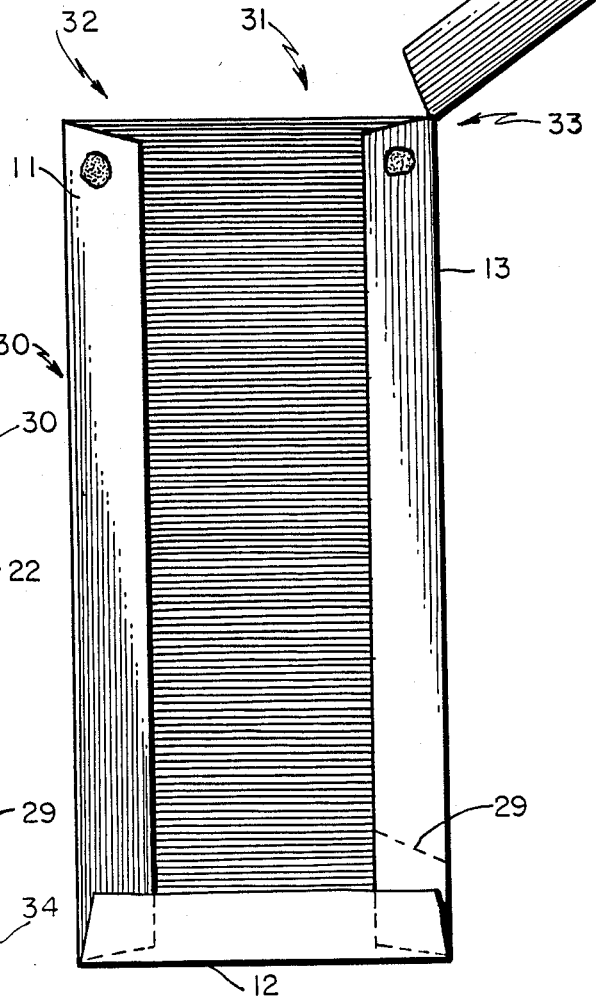

The package shown in FIG. 3 has glued corners 32, 33, 34, 35 and a glued end flap 15. The packages are shipped to the user in this form. When it is desired to use the envelopes 31, the package 30 is opened by reversing the forming steps outlined hereinbefore.

Figure 4:
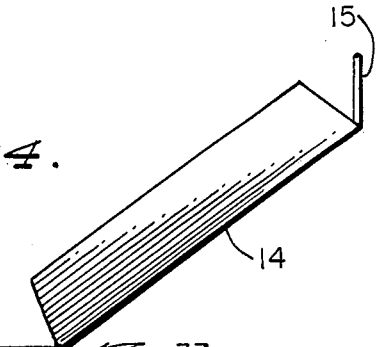
FIG. 4 is a view similar to FIG. 3 showing the first step in opening the package.

FIG. 4 shows a first step in opening the package. For this purpose, the first end panel 14 is lifted upwardly by breaking the glued connections at 32 and 33, and releasing flap 15 from bottom panel 11. The same result could be achieved by including a perforated line in place of score line 19 between front end panel 14 and glue flap 15, or by including a tear strip or other opening means in front end panel 14 as described later on. The wrapper 30 may then be rotated back to a horizontal position as shown in FIG. 5 for dispensing the envelopes 31 into a typical feeding bin or the like.

Figure 5:
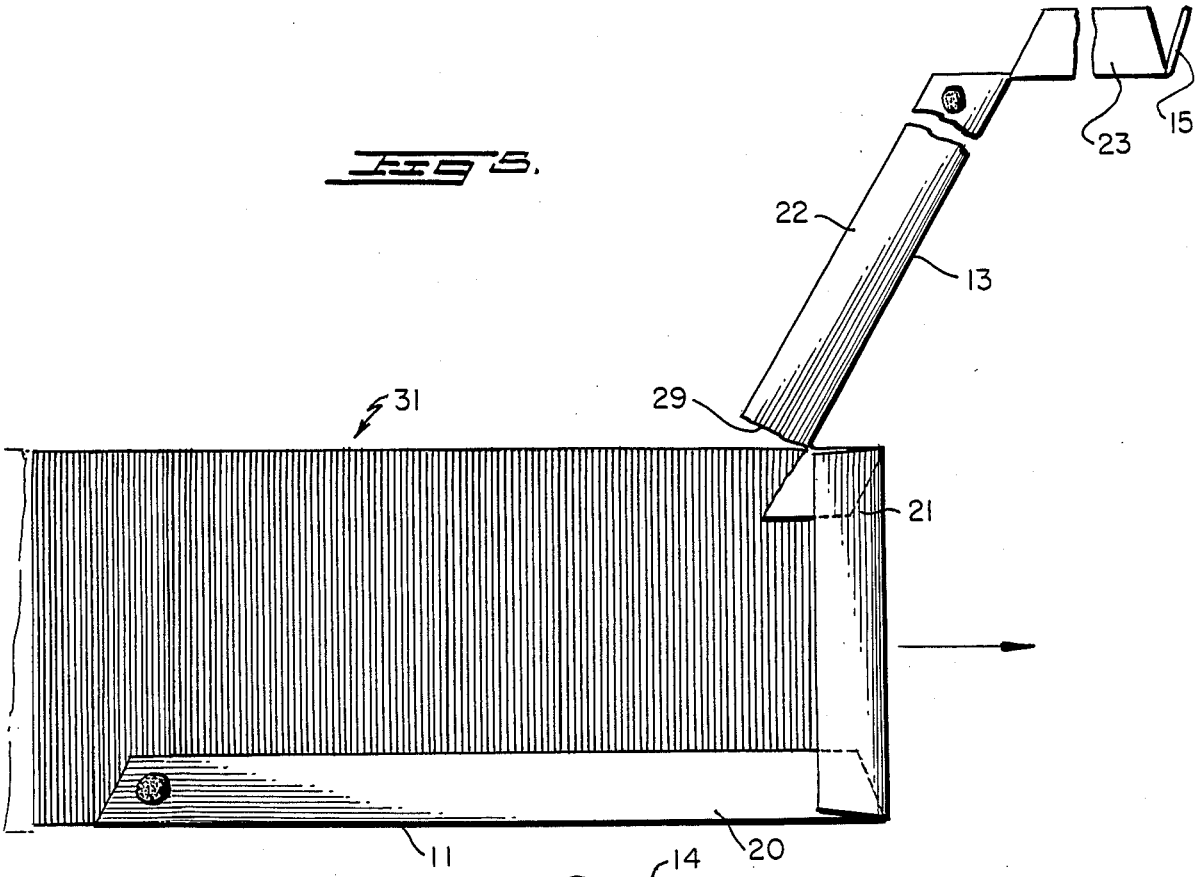
FIG. 5 is a side view showing the second step in opening the package for loading the packaged articles into automatic inserting equipment.

FIG. 5 shows the stacked envelopes 31 ready to be loaded into the feeding bin or magazine of a typical automatic inserting apparatus. For this purpose, the top panel 13 is folded back along score line 28 after breaking the perforations 29, 29 in each flap extension 22. In this condition, the wrapper 30 will still hold the envelopes 31 in their stacked form, but after the envelopes are loaded into the magazine, the wrapper can readily be lifted away and discarded.

Figure 6:
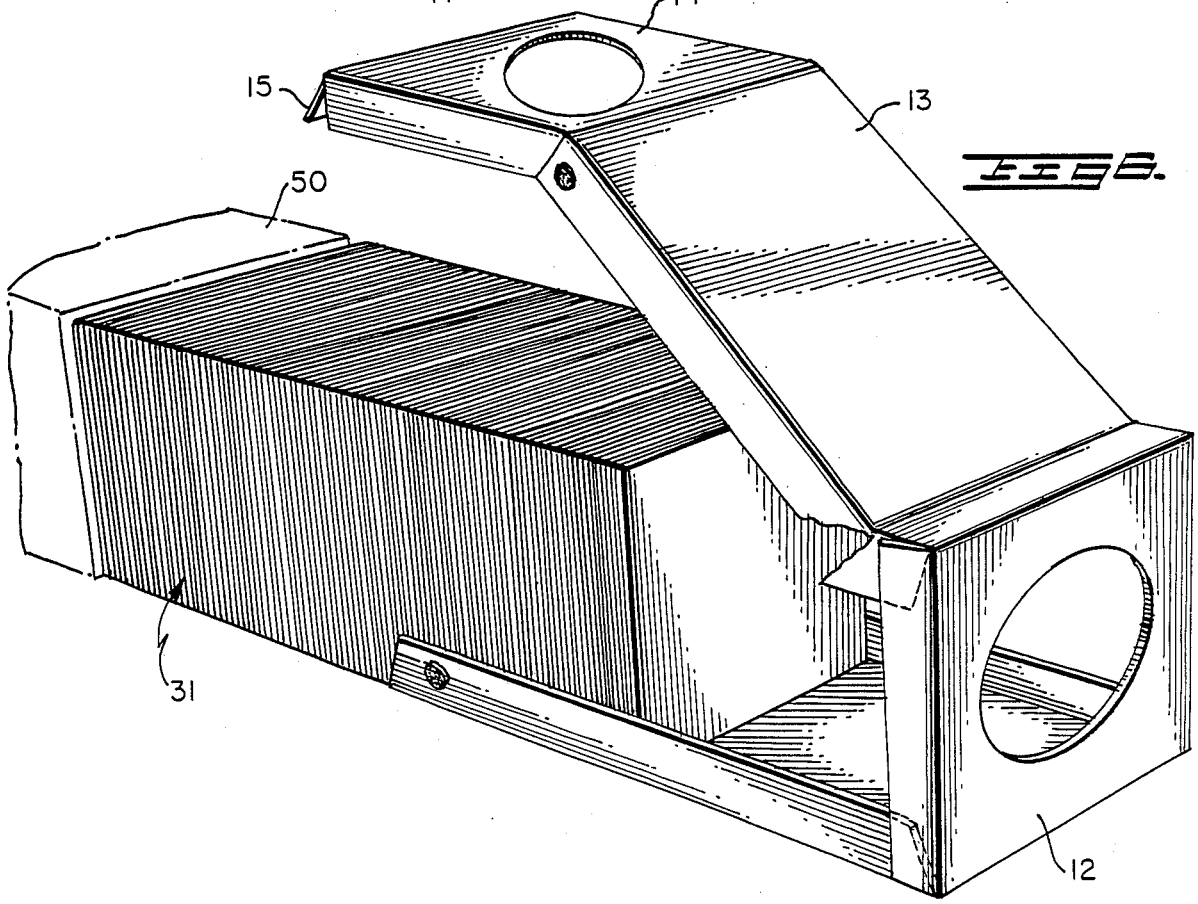
FIG. 6 is a perspective view showing the opened package and the packaged articles being loaded into a feeding bin.

FIG. 6 is a perspective view of the wrapper shown in FIG. 5 showing the stacked envelopes 31 being loaded into a generally horizontally oriented feeding bin or magazine 50 (shown schematically). It should be readily apparent that the package would work equally well with other feeding bins of the vertical type.

Figure 7:
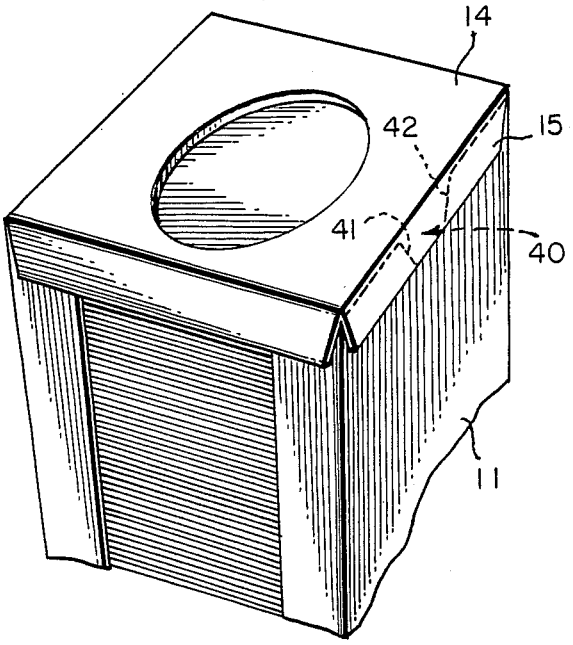
FIG. 7 is a partial perspective view showing a modified construction for opening one end of the package.
Figure 8:
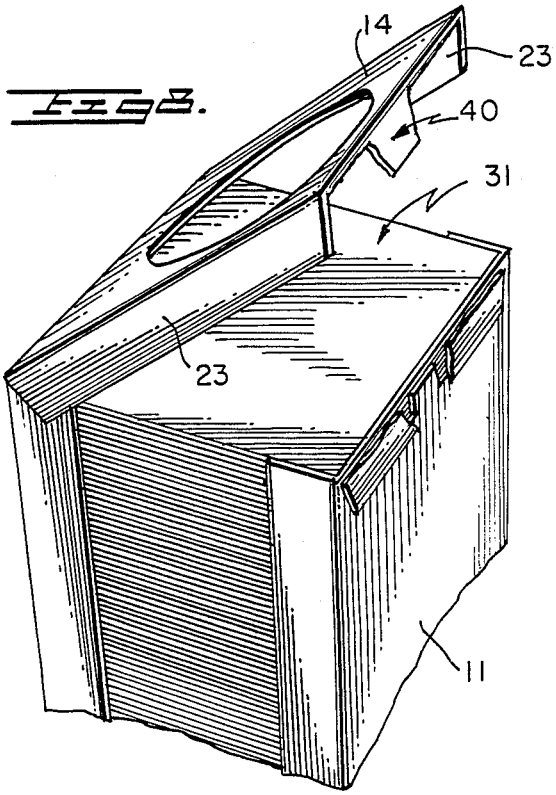
FIG. 8 is a partial perspective view showing the modified construction of FIG. 7 open.

FIG. 7 shows a first modification for opening one end of the wrapper. In this example a pair of perforated lines 41, 42 are applied to the glue flap 15 in the vicinity of score line 19. These perforated lines are arranged to terminate at the edge of flap 15 in the form of a lift tab 40. In order to open the package shown in FIG. 8, the lift tab 40 is lifted upwardly to break the perforated lines 41, 42 and release the front end panel 14 for providing access to the stacked envelopes.

Figure 9:
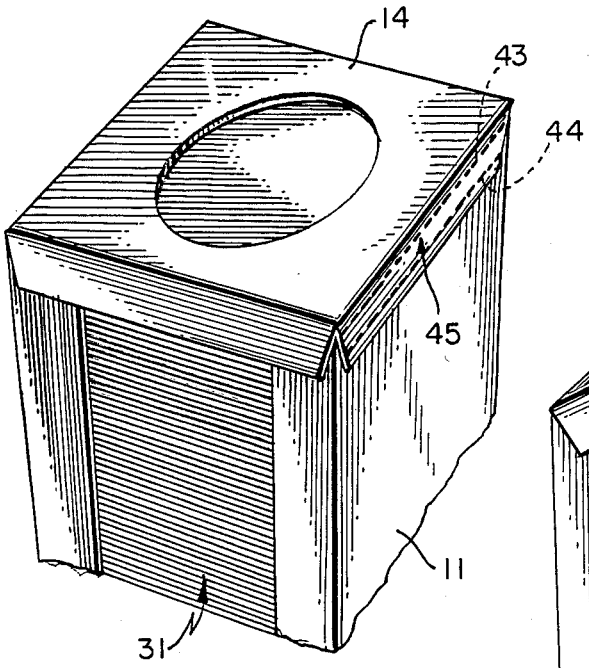
FIG. 9 is a partial perspective view showing a second modification for opening one end of the package.
Figure 10:
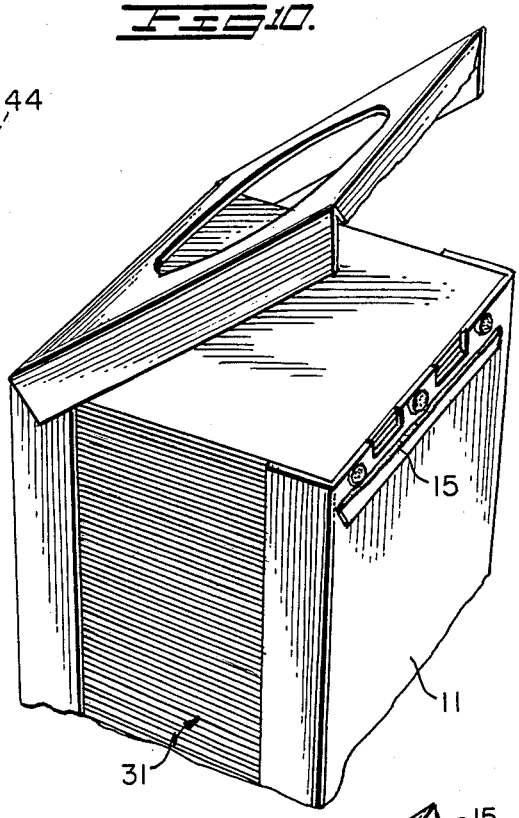
FIG. 10 is a partial perspective view showing the modified construction of FIG. 9 open.

FIGS. 9 and 10 illustrate a second modification for opening one end of the wrapper. In this instance a tear strip 45 is formed in the glue flap 15 by spaced perforated lines 43, 44. When the tear strip is removed as shown in FIG. 10, the front end panel 14 may be lifted upwardly to provide access to the stacked envelopes 31.

Figure 11:
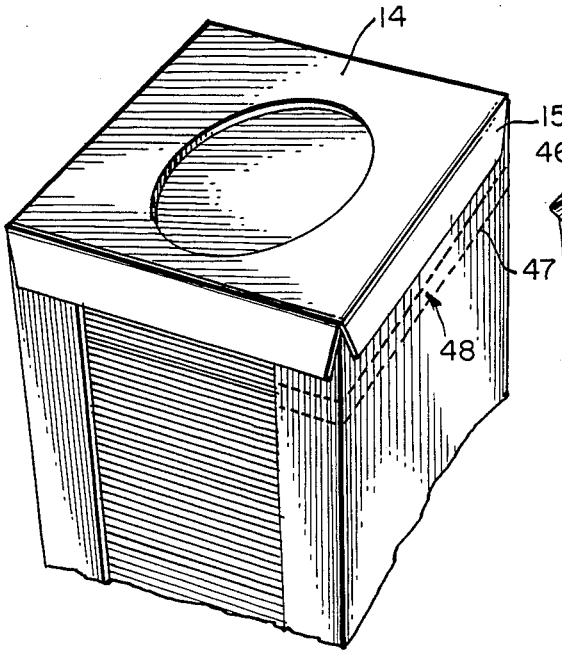
FIG. 11 is a partial perspective view showing a third modification for opening one end of the package; and, FIG. 12 is a partial perspective view showing the modified construction of FIG. 11 open.
Figure 12:
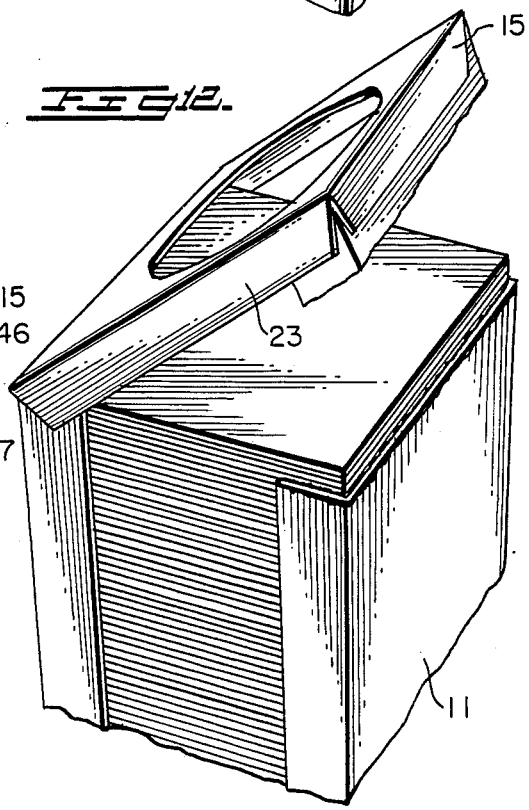

FIGS. 11 and 12 show a third modification for opening one end of the wrapper. For this purpose, a pair of perforated lines 46, 47 are applied to the bottom panel 11 and the adjacent flap extensions 20, 20. These perforated lines form a tear strip 48 which may be removed to open the wrapper as shown in FIG. 12.

From the foregoing it is apparent that the present invention provides an effective means for packaging a stack of envelopes or the like for use in automatic inserting apparatus. The design of the package or wrapper provides a relatively rigid structure for retaining the stacked envelopes together, yet the open sides and ports at each end of the package provides easy identification of the contents of the package. Meanwhile the easy opening means incorporated into the package permits the contents to be easily dispensed into automatic inserting equipment. Thus, the package of the present invention is especially advantageous to large volume users of bulk envelopes using automatic inserting equipment.

While the present disclosure sets forth a preferred embodiment of the invention, obvious changes may be made in the construction and the steps involved in producing and using the package without departing from the spirit of the invention as set forth in the appended claims.

What is claimed is:

1. A combination package/dispenser for a plurality of flat, stacked articles prepared from a single elongated blank of paperboard or the like comprising a plurality of panels including front panel, a top panel foldably attached to one edge of said front panel and a glue flap foldably attached to the opposite edge of said front panel, a rear panel foldably attached to the end of said top panel opposite said front panel and a bottom panel foldably attached to the end of said rear panel opposite said top panel, a plurality of flap extensions of abbreviated length attached to and extending for the entire length of the opposed edges of said front and rear end panels, the top panel and the bottom panel, means for adhering the corners of said flap extensions to one another and for adhering the glue flap to the end of the bottom panel for enclosing the stacked articles, an opening means incorporated into the top panel and its adjacent flap extensions for providing access to and dispensing of said stacked articles, said opening means comprising a score line located in said top panel near the rear panel which extends across said top panel in a direction generally parallel to the fold line between said top panel and rear panel, a pair of perforated lines located in the flap extensions attached to the edges of said top panel, said perforated lines extending generally diagonally within said extension flaps from the ends of said score line away from said rear panel and terminating at the edges of said flap extensions, and a further means for releasing the front panel from the package in the vicinity of said glue flap whereby said package may be opened and access gained to the flat, stacked articles by breaking the perforated lines and folding the top panel rearwardly about said fold line.

2. The package of claim 1 wherein the further means for opening said package comprises a lift tab formed in said glue flap by a pair of perforated lines which extend from the ends of said glue flap toward the center thereof where they are diverted downwardly and terminate at the edge of the glue flap to form the lift tab.

3. The package of claim 1 wherein the further means for opening said package comprises a tear strip formed by a pair of generally parallel, spaced apart perforated lines in said glue flap which extend between the ends of said glue flap.

4. The package of claim 1 wherein the further means for opening said package comprises a tear strip formed by a pair of generally parallel, spaced apart perforated lines located in said bottom panel and its adjacent end flap extensions near said front panel.

5. A method for dispensing a plurality of flat, stacked articles from a combination package/dispenser as described in claim 1 comprising the steps:

(a) rotating the package/dispenser so that it stands upright on its rear end panel;

(b) releasing the front panel from the package in the vicinity of said glue flap;

(c) breaking the glued connections between the corners of the extension flaps attached to the front end panel and the bottom and top panels;

(d) rotating the container/dispenser so that it rests on its bottom panel;

(e) breaking the perforated lines in each of the extension flaps attached to said top panel; and (f) folding the top panel back about the score line formed therein opposite said perforated lines near its rear end panel.

* * * * *